US010195472B1

(12) United States Patent
Jesclard, Jr. et al.

(10) Patent No.: US 10,195,472 B1
(45) Date of Patent: Feb. 5, 2019

(54) PASSIVE FIRE PROTECTION SYSTEM

(71) Applicant: Hazard Protection Systems, Inc., Anchorage, AK (US)

(72) Inventors: Lawrence L. Jesclard, Jr., Anchorage, AK (US); Candice J. Jesclard, Anchorage, AK (US); A. Brent Strong, Sandy, UT (US); John D. Schaalje, Kernersville, NC (US)

(73) Assignee: HPS Intellectual Property, LLC, Anchorage, AK (US)

( * ) Notice: Subject to any disclaimer, the term of this patent is extended or adjusted under 35 U.S.C. 154(b) by 108 days.

(21) Appl. No.: 14/531,809

(22) Filed: Nov. 3, 2014

Related U.S. Application Data

(63) Continuation of application No. 12/440,365, filed as application No. PCT/US2007/025622 on Dec. 14, 2007, now Pat. No. 8,875,802.

(60) Provisional application No. 60/876,362, filed on Dec. 20, 2006.

(51) Int. Cl.
*A62C 3/06* (2006.01)
*A62C 8/06* (2006.01)

(52) U.S. Cl.
CPC ..... *A62C 8/06* (2013.01); *A62C 3/065* (2013.01)

(58) Field of Classification Search
CPC ..... A62C 3/06; A62C 3/065; A62C 3/0257; A62C 8/06
USPC ..... 169/45, 46, 48–50
See application file for complete search history.

(56) References Cited

U.S. PATENT DOCUMENTS

| | | | |
|---|---|---|---|
| 1,668,940 | A | 5/1928 | Burke, Jr. |
| 1,745,909 | A | 2/1930 | Paulus et al. |
| 2,340,370 | A | 2/1944 | Doyle |
| 2,358,848 | A | 9/1944 | Carter |
| 3,698,597 | A | 10/1972 | Burke |
| 3,710,855 | A | 1/1973 | Osorio |
| 3,782,475 | A | 1/1974 | Schmidt |
| 3,813,279 | A | 5/1974 | Varner |
| 4,100,970 | A | 7/1978 | Kreske, Jr. |
| 4,121,666 | A | 10/1978 | Roznieck i |
| 4,132,271 | A | 1/1979 | Mikaila |
| 4,215,752 | A | 8/1980 | Gerow et al. |
| 4,251,579 | A | 2/1981 | Lee et al. |
| 4,262,479 | A | 4/1981 | Lenorak |
| 4,763,731 | A | 8/1988 | Adams et al. |
| 4,992,310 | A | 2/1991 | Gelb et al. |
| 5,490,566 | A | 2/1996 | Purser |
| 5,588,186 | A | 12/1996 | Ko |
| 5,762,145 | A | 6/1998 | Bennett |
| 5,885,912 | A | 3/1999 | Bumbarger |
| 6,200,664 | B1 | 3/2001 | Figge et al. |
| 6,322,873 | B1 | 11/2001 | Orologio |
| 6,521,362 | B2 | 2/2003 | Koeppen |
| 6,572,948 | B1 | 6/2003 | Dykhoff |
| 6,796,382 | B2 | 9/2004 | Kaimart |
| 6,915,861 | B2 | 7/2005 | Goodworth et al. |

(Continued)

*Primary Examiner* — Jason J Boeckmann
(74) *Attorney, Agent, or Firm* — Booth Udall Fuller, PLC

(57) ABSTRACT

A blanket providing a plurality of pockets in which to contain fire suppression compound. A blanket can be wrapped around a container of flammable liquid to resist fire resulting from a ballistic attack. Fire suppression compound carried in a pocket may be provided as a plurality of sub-portions individually disposed in a respective pouch. End caps may also be included to further surround a container with fire suppression compound.

11 Claims, 8 Drawing Sheets

(56) References Cited

U.S. PATENT DOCUMENTS

| | | | | |
|---|---|---|---|---|
| 6,948,567 | B1 | 9/2005 | Cyphers et al. | |
| 6,983,805 | B2 | 1/2006 | Chattaway | |
| 7,083,000 | B2 | 8/2006 | Edwards et al. | |
| 7,083,333 | B2 | 8/2006 | Hodgson | |
| 7,832,038 | B2 * | 11/2010 | Murphy | B32B 3/12 428/102 |
| 2002/0095946 | A1 | 7/2002 | Greene | |
| 2004/0262018 | A1 | 12/2004 | Roussin | |
| 2005/0051345 | A1 * | 3/2005 | Calderwood | A62C 8/06 169/49 |
| 2005/0118383 | A1 | 6/2005 | Cargill et al. | |
| 2007/0068686 | A1 | 3/2007 | Bennett et al. | |

* cited by examiner

PASSIVE FIRE PROTECTION SYSTEM

PRIORITY CLAIM

This application is a continuation application of the earlier U.S. patent application Ser. No. 12/440,365 titled "PASSIVE FIRE PROTECTION SYSTEM," filed Mar. 6, 2009, which is a 371 National Stage application of the earlier International PCT Patent Application No. PCT/US2007/025622 titled "PASSIVE FIRE PROTECTION SYSTEM," filed Dec. 14, 2007, which claims the benefit under 35 U.S.C. 119(e) of the filing date of U.S. Provisional Patent Application No. 60/876,362 titled "PASSIVE FIRE PROTECTION SYSTEM," filed Dec. 20, 2006, the contents of each of which are incorporated herein by this reference in their entireties.

TECHNICAL FIELD

This document relates to devices and methods for suppressing fire that may be caused by a high energy impact being imparted onto a container of flammable liquid.

BACKGROUND ART

When a container of flammable liquid is subject to a high energy or ballistic impact, there is a risk of a deflagration or fire. A sufficiently energetic impact can atomize a portion of the flammable liquid and mix the atomized liquid with air. Such a mixture combines a misted liquid fuel with oxygen, which greatly facilitates its ignition. Ignition of the atomized liquid mist can be caused by a small spark, or even by the energy of the impact. The burning atomized portion may then cause flame propagation to the bulk liquid.

Conventional passive fire protection systems encompass non-powered, self-contained assemblies. Unlike an active system, a passive system typically requires only a visual inspection to insure that the system has not been compromised or damaged. Such an inspection can often be conducted relatively quickly without rendering the fire protection system inoperable. Examples of passive fire systems include fire rated assemblies, pressure relief systems and fire extinguishing technologies that are autonomously applied directly to a hazard. Passive systems normally are simplistic in design to insure operability and reliability.

DISCLOSURE OF INVENTION

The present document discloses an apparatus and method to provide a passive fire-protection system to a container of flammable/combustible liquid. Embodiments may include one or more of the features disclosed below. A currently preferred embodiment, structured according to certain principles of the instant invention, includes a blanket having a length and a width. The blanket is structured and arranged for flexible accommodation to permit wrapping its width around a portion of the exterior of a container of flammable/combustible liquid, optionally without requiring removal of the container from an anchoring foundation. The blanket provides a plurality of pockets disposed in a first layer. Retention structure is adapted to maintain the blanket in wrapped registration with the container to dispose the blanket length substantially in parallel with a length axis of the container. Therefore, fire suppression compound disposed in a plurality of blanket pockets is distributed around the container. At the locus of a ballistic impact, mixing a heat absorbing fire suppression compound with the fuel/air mixture may be sufficient to absorb the heat faster than the flame front, caused by the mechanical effects of the impact, can consume the fuel expelled by the energy of the impact.

Certain currently preferred embodiments are structured to dispose fire suppression compound substantially completely around a perimeter of the container. If required, more than one blanket may be provided in series to dispose fire suppression compound substantially completely along the length of the container. Certain blankets provide a plurality of elongate pockets disposed substantially in parallel with the length of the blanket. A retention structure may also be included that is adapted to maintain the blanket in wrapped registration with the container to dispose the blanket substantially around the exterior of the container (e.g., dispose the blanket length substantially in parallel with a length axis of the container).

The blanket may include a plurality of layers. For example, a second layer may be structured in harmony with a first layer to dispose a pocket, formed in the second layer, as a cover, over an area between adjacent pockets in the first layer, effective to form a staggered pocket arrangement through-the-thickness of the blanket. It may also be desirable to provide suspension structure operable to hold the blanket in substantially intimate contact against the exterior surface of a container to promote causing distribution of an amount of compound during a rebound event caused by a high energy impact onto the container.

Sometimes, fire suppression compound disposed in one blanket pocket may include a plurality of sub-portions of fire suppression compound, each such sub-portion being individually packaged in a respective pouch, which may be water-resistant. A workable pouch may be formed from plastic-like membrane or film. For example, a pouch may include an inner layer essentially surrounded by an outer layer, either of (or both of) which may be water-resistant.

Sometimes, a fire suppression apparatus may include one or more end cap. For example, a first end cap may be structured to dispose fire suppression compound substantially over the area of one end of the container. A second end cap may be structured to dispose fire suppression compound substantially over the area of the opposite end of the container. A retaining structure may also be included effective to resist axial separation, between the first and second end caps, from an installed position on a cylindrical container, such as a vehicle fuel tank. One operable retaining structure comprises an axially oriented strap in combination with a quick-connect buckle.

An end cap for a vehicle fuel tank may include a plurality of elongate pockets disposed to permit their substantially horizontal disposition upon installation of the end cap onto the container. Certain end caps may further include a skirt portion that is structured to overlay an axial portion of the container. In certain cases, a skirt and blanket can be structured in harmony to permit forming an overlapped portion there-between upon their installation onto a container. Certain skirts include a plurality of pockets carrying fire suppressant compound effective to dispose fire suppressant compound around a perimeter portion of the container.

Holding structure associated with a skirt may be adapted to maintain the end cap in an installed position. Holding structure may also place a portion of the skirt or a blanket into intimate contact with the exterior circumference of a cylindrical container of flammable/combustible liquid. One operable holding structure comprises a strap and an associated ratchet mechanism.

Some pockets may be essentially permanently sealed during manufacture of a blanket. However, a workable pocket may include a re-closeable access opening that may be closed sufficiently to resist undesired egress of fire suppression compound from its interior, and that may be opened sufficiently to permit replacement of a portion of fire suppression compound, or visual inspection.

In another aspect, this document discloses methods for manufacturing a fire suppression blanket element of a passive fire protection system. One operable method includes forming a blanket shell having a plurality of pockets. Then, the pockets are stuffed with fire suppression compound. Typically, the blanket shell includes a plurality of elongate pockets disposed substantially in parallel along a pocket axis and having at least one access opening each. A sub-portion of fire suppression agent may be placed into an individual pouch. Generally, a plurality of pouches are formed in this manner. Then, a pouch, or pouches, can be inserted through one access opening into confinement in the interior of one of the pockets. Subsequently, the access opening may be sealed sufficiently to resist undesired egress of the pouch, or pouches, from the interior of the pocket. Sometimes, the step of forming the blanket shell includes fastening overlapped planar portions of a pair of drapeable membrane sheets together along a plurality of boundaries effective to form side boundaries of pockets. A workable membrane material includes fabric formed from aramid fibers.

One operable fire suppression apparatus includes a fire suppression blanket. The blanket includes a shell providing a plurality of substantially parallel elongate pockets. Fire suppression compound is disposed in a plurality of the pockets. The compound in at least one pocket may include a plurality of sub-portions, each such sub-portion being disposed in a respective pouch. Each pocket that holds fire suppression compound can have an access opening structured to be sufficiently closeable as to resist undesired egress of compound from confinement therein. The apparatus may further include suspension structure operable to hold the blanket in substantially intimate contact against the exterior surface of a container of flammable/combustible liquid effective to cause distribution of an amount of compound during a rebound event. Sometimes, the blanket is structured to permit its storage in a substantially planar shape, and is sufficiently flexible as to permit installation by way of wrapping the blanket around a container.

BRIEF DESCRIPTION OF THE DRAWINGS

In the Drawings, which illustrate exemplary structures that include what are currently considered to be the best modes for carrying out the invention.

MODES FOR CARRYING OUT THE INVENTION

Reference will now be made to the drawings in which the various elements of the invention will be given numerical designations and in which the invention will be discussed so as to enable one skilled in the art to make and use the invention. It is to be understood that the following description is only exemplary of the principles of the present invention, and should not be viewed as narrowing the claims which follow.

For purpose of this disclosure, the terms "fire suppression", "fire-fighting", and "fire-extinguishing", are terms used in their broadest sense, and may be used somewhat interchangeably. Such terms are believed to be substantially analogous and at least partially overlapping in scope. The scope intended to be encompassed by use of any one of such terms is hereby defined by the breadth falling within the ambit of "fire suppression", which is believed to be most broad and all-encompassing. Likewise, "blanket" is a term used in its broadest sense and may refer to any flexible, pliable, and the like (susceptible of modification or adaptation; willing or disposed to yield) surface, layer, covering, sheet, form, piece, and the like that may cover, wrap, and/or enclose. Similarly, the terms "agent", "compound", and "substance" are terms used in their broadest sense, and may be used somewhat interchangeably for purpose of conveying the principles of operation of apparatus and methods. Further, the term "flammable liquid" is used in its broadest sense, and is intended to also encompass a combustible liquid or other substance. Additionally, the term "pocket" is a term used in its broadest sense and may refer to any receptacle, compartment, hollow, recess, cavity, and the like. Moreover, the term "pouch" is a term used in its broadest sense and may refer to any bag, sack, container, receptacle, envelope, wrapper, surrounding cover, and the like that may be removably or permanently closeable, sealable, and the like. A length axis may be associated with an object and may sometimes be characterized as a vector parallel to a coordinate axis, such as any one of the axes in a Cartesian or polar coordinate system.

Figure 1:
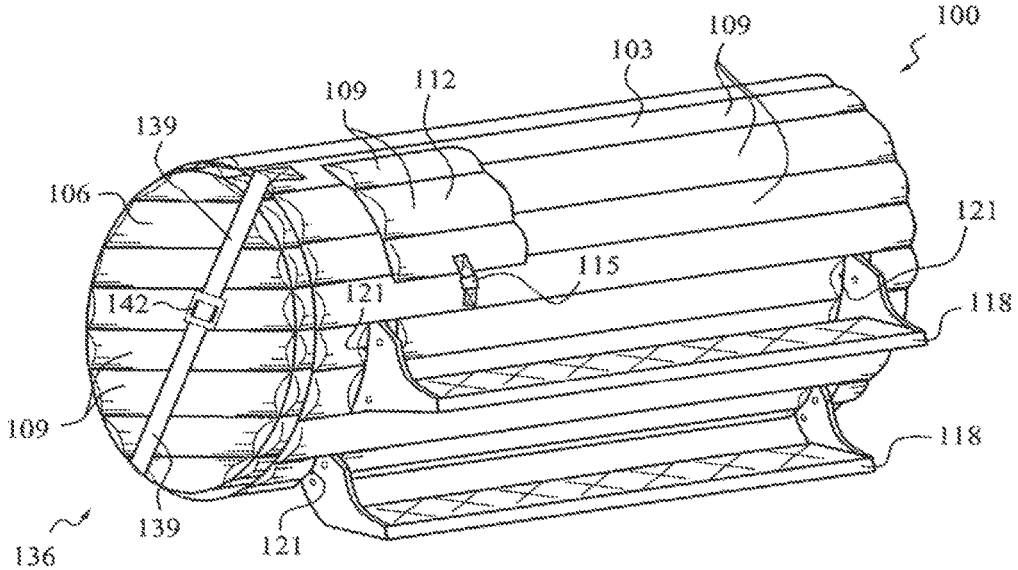
FIG. 1 is a view in perspective of a vehicle-mounted fuel tank wrapped within an embodiment of a passive fire suppression apparatus.

A first embodiment of a passive fire suppression apparatus within the ambit of the instant invention is indicated generally at 100 in FIG. 1. The apparatus 100 includes a blanket 103 and a pair of oppositely disposed end caps 106. In general, an end cap may be regarded as a blanket, typically having a specialized perimeter shape that is adapted to fit in registration with an end of a container. In some passive fire suppression embodiments, the end caps 106 are separate elements from the blanket 103, although such is not a requirement.

Fire suppression compound is typically carried in a plurality of pockets 109 formed in the blanket 103 and end cap 106. Such fire suppression compound may be distributed partially or substantially entirely over the surface of a container of flammable or combustible liquid. In combination, the illustrated blanket 103 and end caps 106 may substantially cover the surface of a container of flammable/combustible liquid, such as the fuel tank on which they are illustrated in an installed position.

It is currently preferred to form a blanket 103 and an end cap 106 as multi-part assemblies including shells made from drapeable membrane material, such as cloth. Facing sheets of cloth may be stacked, cut to a pattern shape, and through-stitched to form pockets 109 and otherwise secured together. Desirably, the shell is sufficiently rugged as to withstand damage from casual abuse, such as from rocks or road debris when under way, and contact with a booted foot as a driver enters a vehicle. The shell desirably forms a protective housing and outer covering for the fire suppressant compound. However, the shell should tear under a ballistic impact, to release such fire suppressant. Desirably, a blanket can be stored and shipped in a flat configuration, and is sufficiently transversely flexible to permit its installation by wrapping the blanket around a container of flammable/combustible material.

A workable cloth, or cloth-like material, from which to make a shell includes canvass or fabric that may be woven from a wide range of operable materials. Operable materials of construction from which to form a fabric include synthetic fibers, such as Nylon, Rayon, Dacron, Spectra™, Twaron™ and Kevlar™, as well as natural fibers, such as silk, cotton, hemp, and the like, including blends of materials. The currently preferred cloth-like material is an aramid fabric commercially available under part number 5710L/63/A476 from BGF Industries, having a place of business located at 3802 Robert Porcher Way, Greensboro, N.C. 27410, and a web site www.bgf.com.

As illustrated in FIG. 1, a flap-like cover 112 may be provided to dispose fire suppression compound that is carried in one or more pocket 109 over one or more protuberances, such as a fuel filler cap, or a tank vent. In the illustrated embodiment 100, the cover 112 is affixed, e.g. by stitching to form a hinge, at one side to the blanket 103. Cover 112 may be maintained in a closed, or protective, position by way of a fastener arrangement 115. Gravity alone may also be effective to hold cover 112 in an operable position. A workable fastener arrangement 115 includes one or more button, toggle connector, buckle, such as a quick-connect buckle or a pass-through buckle, a hook and a cooperating ring or eye, and the like. An operable fastener arrangement 115 may, or may not, include a strap system. An alternative fastener system operable to maintain flap 112 in a protective position may include a hook-and-loop arrangement, such as a Velcro™ fastener.

It is generally desirable for a passive fire suppression system, such as embodiment 100, to maintain the fire suppression compound in substantially intimate proximity to the surface of the container of flammable/combustible liquid. In such case, fire suppression compound will likely be introduced into any fuel that undergoes a rebound process due to a ballistic event being imparted onto the container. Therefore, provision may be made in a blanket 103, and/or end cap 106, to accommodate certain protruding elements, such as stairs 118. Blanket 103 includes a plurality of through-the-thickness holes 121 through which suspension structure for stairs 118 extends to an anchoring location on the fuel tank. With such an embodiment, the stairs 118 may simply be removed to permit wrapping the blanket 103 around the fuel tank, then reinstalled subsequent to installation of the blanket. Void spaces, such as holes 121, are desirably kept to a minimum to reduce unprotected area associated with a fuel tank, or other container of flammable/combustible liquids.

Desirably pockets, such as pockets 109 in FIG. 1, are structured to be elongate along a length axis and are disposed to position such length axis substantially horizontally in an installed position. Such an arrangement helps to resist packing, or settling, of compound into pocket "bottom" areas effective to cause void spaces at pocket "tops". As illustrated, pockets 109 in FIG. 1 may be characterized as tubular elongate pockets disposed substantially in parallel with the length of blanket 103. It is within contemplation for certain of such pockets to be interrupted along a length axis to form an equivalent pocket structure including an in-line, or even staggered and off-set, series of shorter pockets.

Figure 2:
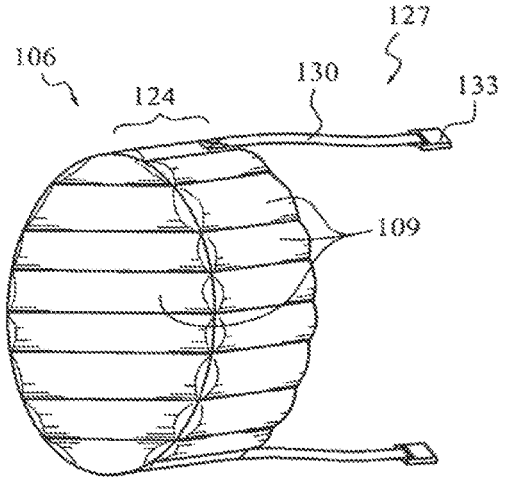
FIG. 2 is a view in perspective of an operable end cap portion of the embodiment illustrated in FIG. 1.

FIG. 2 illustrates one operable end cap generally at 106. End cap 106 includes a skirt portion 124 arranged as a short cylindrical section that may be draped over one end of a cylindrical fuel tank. Skirt 124 includes a plurality of pockets 109 holding fire suppression compound. As illustrated in FIG. 1, blanket 103 may overlap a portion of the skirt 124 to resist formation of void areas.

Retention structure, such as the strap system illustrated generally at 127, desirably is provided to maintain an end cap in an installed association with a container of flammable/combustible liquid. Strap system 127 includes a strap 130 and a connector 133. The axially oriented strap 130 and connector 133 cooperate with corresponding such structure carried by an oppositely disposed end cap to resist axial separation between a pair of installed end caps. Certain retention structure is effective to maintain a blanket in wrapped registration with a container and to dispose the blanket length substantially in parallel with a length axis of the container.

An additional, or alternative retention structure, such as strap system 136, may be included in association with a blanket, such as blanket 103 illustrated in FIG. 1. Strap system 136 includes a pair of axially oriented straps 139 and a connector 142. As illustrated, ends of straps 139 may be attached directly to the blanket 103. A workable connector 142 includes a quick-connect buckle, pass-through buckle, and the like, which permit the strap system 136 to be snugged as desired. Straps 139 are arranged to span from side-to-side across an installed end cap, and therefore assist in maintaining a blanket in association with an end cap, and the resulting assembly in association with a container of flammable/combustible liquid.

Figure 3:
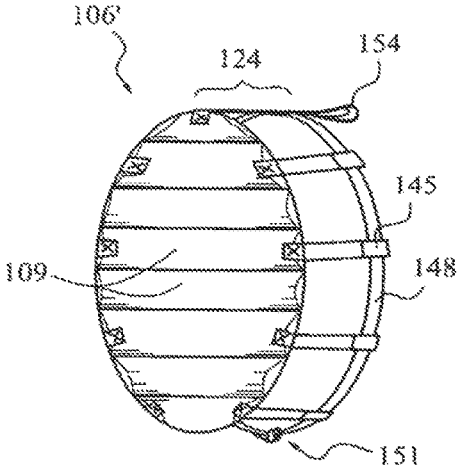
FIG. 3 is a view in perspective of an alternative end cap portion workable in an embodiment such as illustrated in FIG. 1.

The end cap 106' illustrated in FIG. 3 includes a skirt 124 that includes a plurality of axially directed extension straps 145. Each strap 145 can be formed, in part, by folding and fastening to provide a loop in which circumferential strap 148 may be contained. Circumferential strap 148 may be snugged into compression against the fuel tank, and any intervening structure, by operating a connector, such as ratchet buckle 151. An operable ratchet buckle includes part No. FC45B, commercially available from Austrialpin N.A. IN, having a place of business located in Bazzmore, Alberta Province, Canada, and a web site located at http://www.austrialpin.com.

Optionally, structure having an identifying feature, such as king strap 154, may be provided to facilitate installation of the end cap 106'. Illustrated king strap 154 has an extended length and provides a hand-hold that may be employed by an installer to hold the end cap in a desired registration with respect to a fuel tank during its installation. The king strap 154 may be positioned at a fixed location, such as top dead center on the tank, to facilitate orientation of the pockets with respect to the ground. The pockets 109 are substantially horizontal in the most desirable installed position.

The pocket width, which is generally perpendicular to the pocket length, may be sized to provide for a desired thickness of fire suppression compound. In certain embodiments 100, pockets 109 that are more "skinny" cause a thinner overall blanket layer. Conversely, in such embodiments 100, pockets 109 that are more wide result in a blanket layer that will generally be more thick. In one exemplary embodiment, certain pockets 109 are about 6 inches (15 cm) in width. Of course, sometimes pocket width may be determined, at least in part, by a size of protuberance structure for which cut-out areas must be provided. Operable blanket thickness is believed to be perhaps 0.1 inch (0.3 cm), or less in thickness, depending upon the ballistic impact, or threat, being defended against. Thicker blankets may improve survivability in the face of a more significant ballistic impact, but inevitably carry a correspondingly larger weight penalty. Certain blankets for application to military fuel tanks have a representative thickness (which can vary over the area of the blanket) in the vicinity of between about 0.375 inches to about 2 inches (1 to 5 cm).

Figure 4:
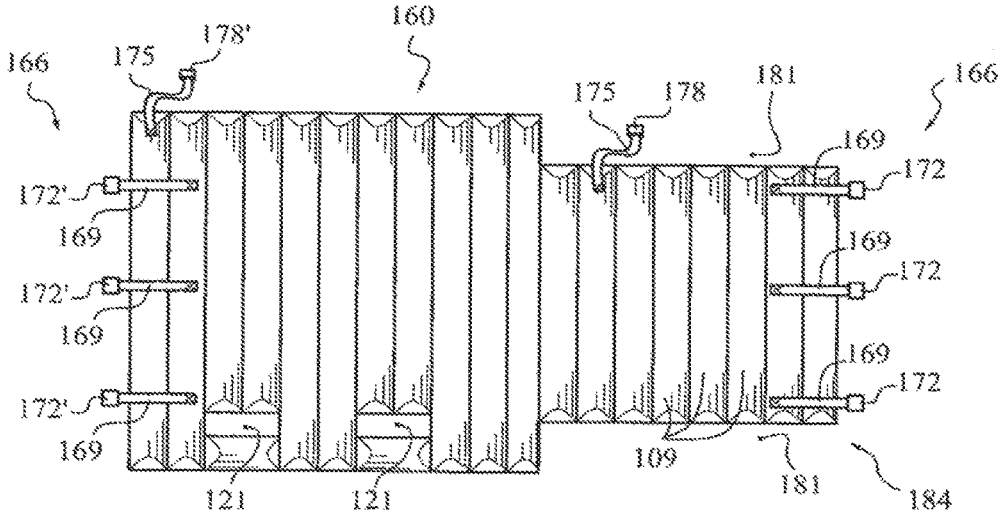
FIG. 4 is a plan view of a first blanket portion of a fire suppression apparatus constructed according to certain principles of the instant invention.
Figure 5:
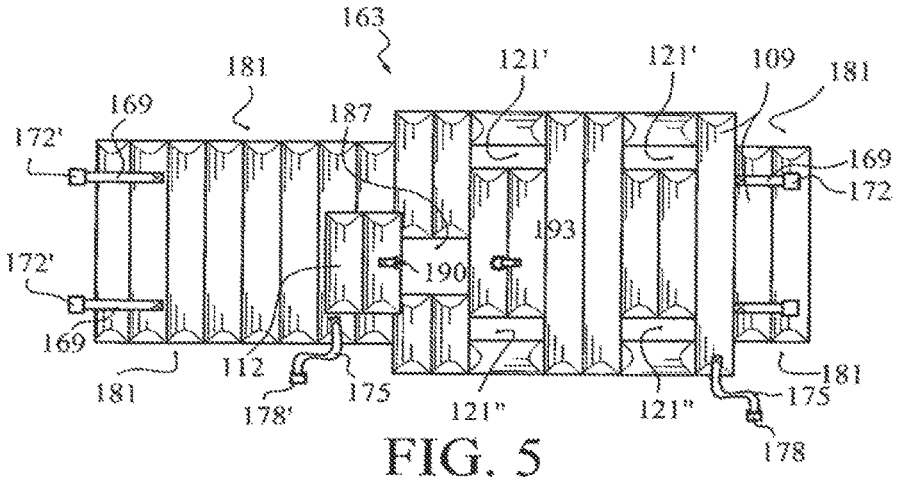
FIG. 5 is a plan view of a second blanket portion structured to operate in harmony with the blanket illustrated in FIG. 4.

FIGS. 4 and 5 illustrate a two-part blanket system adapted to provide threat protection to a fuel tank that is longer than the tank protected by blanket 103 in FIG. 1. The blankets 160 and 163 are illustrated as being stretched out flat, in a substantially planar position. Desirably, blankets structured according to certain principles of the instant invention are capable of being stored in a similar flat position, and can be installed by wrapping the blanket around a container of flammable/combustible liquid. The principle of applying a plurality of axially adjacent blankets also applies to protection of other elongate structures, such as pipelines or refinery structures, against ballistic attack.

Figure 6:
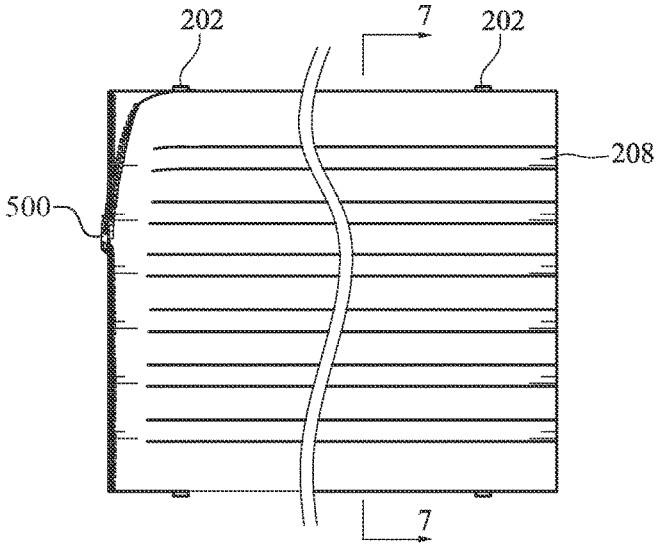
FIG. 6 is a view in elevation of a fire suppression blanket and reinforcement layer wrapped around a rectangular fuel tank.

Blanket 160, illustrated in FIG. 6, includes retention structure, generally indicated at 166, operable to maintain blanket 160 in registration with a container of flammable/combustible liquid. Retention structure 166 includes a plurality of circumferentially oriented straps 169 and cooperating coupling structures 172 and 172'. Typically, coupling structures 172, 172' encompass quick-connect buckles, or other convenient devices operable to connect and take up slack in straps 169. The straps 169 may therefore be snugged to stretch the blanket in a width direction and place the blanket 160 into substantially intimate contact around the circumferential exterior of a container, such as a fuel tank. Sometimes, an overlap may be formed by blanket portions disposed under straps 169 as the blanket 160 is wrapped around the circumference of a fuel tank.

Axially oriented straps 175 and cooperating connection devices 178 and 178' may be fastened over an end cap, and also may help to maintain the blanket 160 in registration with the fuel tank. Similar to the circumferential retention structure, coupling structures 178, 178' typically encompass quick-connect buckles, or other convenient devices operable to connect and take up slack in straps 175. The straps 175 may therefore be snugged to stretch the blanket in a length direction and place the blanket 160 into substantially intimate contact around the exterior of a container. Straps 175 also may assist in maintaining an end cap in registration with the fuel tank.

Cut-out holes 121 provide access ports through which protruding suspension structure for stairs may pass to an anchor location on the tank. Cooperating holes 121' are provided in blanket 163 for the same suspension structure. Therefore, an overlap between blankets 160, 163 is formed in the stair area subsequent to installation of the two blankets 160, 163.

It is desirable to provide ballistic threat protection to containers of flammable or combustible liquid, such as vehicle-mounted fuel tanks, which does not require disassembly of such fuel tanks from tank-anchoring structure associated with their respective vehicles. Therefore, a circumferential slot 181 may be formed to avoid a cradle anchor of a fuel tank, and thereby permit wrapping the width of a blanket 160, 163, around a portion of the exterior of a fuel tank without requiring removal of the tank from an anchoring foundation on the vehicle. In such case end 184 may be slid between spaced-apart saddle structure and the blanket 160 may be wrapped circumferentially around the installed fuel tank. The void caused by the saddle structure may be covered, or protected, by fire suppression compound disposed in alternative packaging.

Blanket 163 is structured similar to blanket 160, and the similar structures are denoted by similar numerals. Of further note, openings 121' and 121" provide access for the stair foundation structure. Opening 187, which can be covered by flap 112 (illustrated folded up and out of the way), is provided for a fuel filler spout and cap. Cover 112 in FIG. 5 is secured in a closed position by way of snap hook 190 and D-ring 193.

Figure 7:
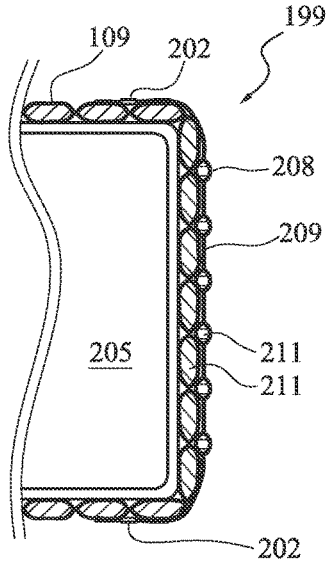
FIG. 7 is a fragmentary cross-section view taken through 7-7 in FIG. 6.

Sometimes, a second or more "filler" layer(s) may be provided, e.g. to place seams between pockets in a staggered relation through-the-thickness. As illustrated in FIGS. 6 and 7, an exemplary such reinforcement layer 199 can be provided that may be simply clipped onto a substrate layer using connection structure 202, such as quick-connect buckles, or straps and pass-through buckles, a zipper, hook-and-loop fastener, staple, rivet, and the like. Preferably, the fastening system 202 permits removal of the reinforcement layer 199. The additional layer 199 may be provided in certain circumstances, such as for flat-surface tanks 205 and the outboard side of round tanks. The additional layer 199 can replicate a layer of a blanket, or may be manufactured as illustrated with more narrow, spaced-apart pockets 208 that are spaced apart by stretches of fabric 209 to lay between the larger main pockets 109, e.g. over the "seam" line only. Such a replaceable layer 199 also provides a convenient way to repair damaged pockets by direct replacement of one or more damaged pocket, or by providing a covering layer. It should be noted that a clip-on layer may also, or alternatively, be disposed between a blanket and the container of flammable/combustible liquid.

Operable fire-fighting compounds or agents that may be incorporated into a fire suppression blanket nonexclusively include: monoammonium phosphate, sodium bicarbonate, potassium bicarbonate, potassium chloride (i.e. "Slow K", "Super K", potassium muriate, mono potassium chloride, and muriate of potash) ammonium polyphosphate, MET-L-X (Ansul), LITH-X (Ansul), G-Plus (Amerex), G-1 (Amerex), graphite, aluminum oxide, silicon dioxide, manganese oxide, MONNEX (Kidde), MX (Kidde), carbon dioxide, nitrogen, pentafloruethane, heptafluoromethane, potassium iodine, propylene glycol, potassium lactate, potassium acetate, iodotrifluoromethane, or any other operable or commercially available or future-developed fire-fighting agent. Based upon fire protection principles, anticipated threats and environmental conditions, one of the above-listed fire-fighting agents or a combination thereof, may be selected. The fire-fighting agent may be powder, liquid, gaseous or a mixture thereof for the assembly process as well as operational requirements. The fire-fighting agent may further include any inert, inorganic, heat-absorbing compound or compound mixture that is effective to suppress or extinguish a fire. The currently preferred fire suppression compound includes potassium bicarbonate, also known as Purple-K. Alternative workable fire suppression compounds include Tin-Oxide, Bismuth Trioxide, and Uranium Oxide, all of which have a relative heat absorption rate (efficacy) of twenty-plus compared to Purple-K which only has a rating of 3.5.

Figure 8:
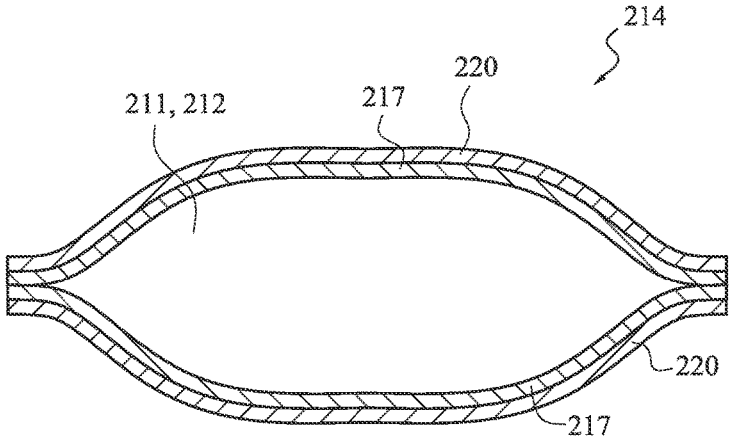
FIG. 8 is a cross-section taken through a pouch of fire suppression compound.

With reference to FIG. 8, fire suppression compound 211 may be provided as pocket-filling sub-portions 212 being individually packaged in a respective pouch 214 (that may be water-resistant) to form a filler. One advantage provided by such an arrangement of individual sub-portions 212 is that the dribble effect is minimized. A dribble effect may be defined as when a hole is formed in a pocket (e.g. by small-caliber fire), and the fire suppression compound slowly pours out. For example, otherwise uncontained fire suppression compound could dribble out from a hole shot into the bottom of a tall pocket during a first ballistic attack, and a resulting large empty pocket would cause a corresponding void in protection during a subsequent attack. Thus, by confining the fire suppression compound 211 into individual pouches 214, the amount of fire suppression compound 211 lost to a small arms hit is limited to only the fire suppression compound 211 in the pouch 214 that is hit. In addition, pouches 214 make blankets more survivable in that blankets can still function even after taking multiple hits. Pouches 214 may also make blankets field restorable in that a hit pouch can sometimes be replaced with an intact one.

With continued reference to FIG. 8, certain pouches 214 may include more that one layer. For example, illustrated and exemplary pouch 214 includes 2 mil polyethylene (PE) on the inside layer 217 and 2 mil polyethylene terephalate (PET) on the outside layer 220. The two plastic materials can be joined together, the pouch 214 is made, the fire suppression compound 211 is dropped in, the top of the pouch 214 is cleaned and then heat sealed. The two dissimilar envelope materials help to resist entrance of water or other fluid into the pouch 214 over the long term. Water would undesirably "cake" a hygroscopic fire suppression agent. It should be noted that a single-layer pouch is also operable. In any case, it is typically desirable for a pouch to resist attack by liquid hydrocarbons, e.g. spilled fuel. In certain cases, an operable pouch may also be formed from one or more material that is not water-resistant.

Pouches 214 used in certain exemplary blankets are typically sized to contain either about 90 gram or 400 gram quantities of fire suppressant 211 for ease of filling and uniformity. The currently preferred pouches 214 are sized about 3 inches.times.3 inches (7.times.7 cm) and 5 inches-.times.9 inches (13.times.23 cm) respectively, but such sizes are of course subject to optimization. The currently preferred empty plastic bags 214 are sized about 3 inches.times.6 inches (7.times.14 cm) for the 90 gram filler and about 5 inches.times.9 inches (13.times.23 cm) for the 400 gram filler. When filled they become pouches 214 that are about 3 inches.times.3 inches (7.times.7 cm) and 4 inches.times.6 inches (10.times.15 cm) respectively, depending upon the amount of trapped air. The process is desirably done in a controlled environment for humidity, e.g. at <5% RH.

In an operable manufacturing process, the fire suppression compound goes through an auger that "drops" the compound into rows of funnels that each have a bag 214 connected at its bottom. Filled envelopes 214 are then squeezed off the funnels to insure the envelope top is clean (otherwise the powder 211 would not allow for a thermal seal). The plastic bags 214 are sealed and you can see the powder 211 move (like an hour glass) within the pouch 214 as they are flipped up and down.

Substantially all fabric seams of the blanket shell can be sewn without pouches present, and then the formed rows of pockets may be stuffed with filler pouches of fire suppression compound. In the case of a fully-sewn-to-seal embodiment, the final seam must generally be sewn carefully to insure an envelope is not compromised by being sewn through. Normally the assembly worker pushes the pouches back as the final seam is sewn, and then pouches are equalized within the rows to fill the space. It is within contemplation to provide a zipper in place of a final sewn seam, or to provide some other structure (such as an overlap, or even butt joint in one fabric or membrane layer of a shell) that can be reversibly opened and closed, to permit installation of filler and/or replacement of one or more damaged filler. Desirably, a zipper is arranged in a substantially straight line to facilitate its operation.

Fire suppression blankets may be manufactured from alternative materials, and by using different methods of construction and attachment to the container, compared to the sewn fabric blankets described above. Certain embodiments may be configured and arranged to provide a system that can be mass-produced in various widths using form, fill, and seal manufacturing. Certain blankets and/or end caps may be formed using Linear Low Density Polyethylene (LLDPE), (PET), or similar flexible materials, in various thicknesses. In manufacturing of such embodiments, sheet LLDPE or PET stock may be cut to size for specific container dimensions. The resulting product can then be applied to new and used vehicles on a retrofit basis by means of operable attachment methods (which may be based upon technical requirements for specific vehicles or processes).

Figure 9:
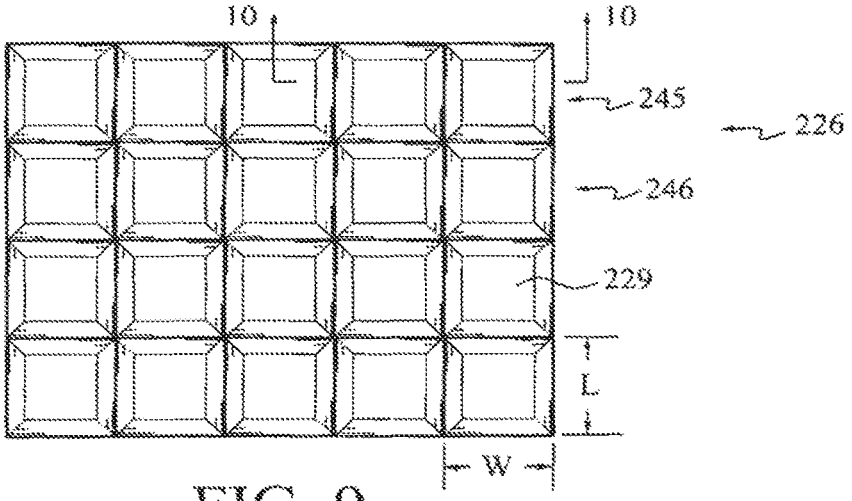
FIG. 9 is a top view of a workable blanket.
Figure 10:
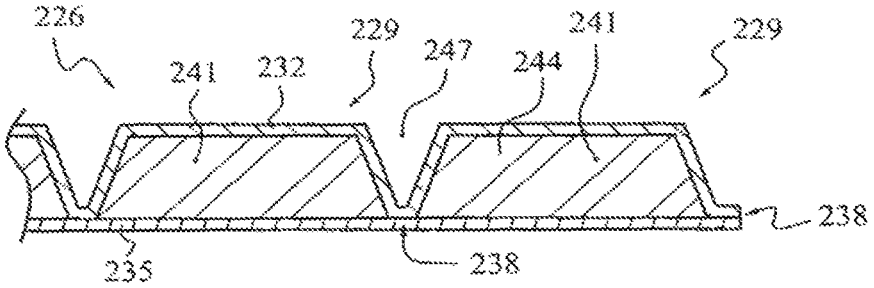
FIG. 10 is a cross-section view taken through section 10-10 in FIG. 9.

The blanket illustrated in FIGS. 9 and 10, and generally indicated at 226, may be manufactured using form, fill, and seal techniques. Individual pockets 229 may be formed essentially in one sealing membrane 232, which is then desirably hermetically sealed by covering membrane 235 at a plurality of connections 238. Connections 238 may include thermally induced adhesions, adhesive materials, simple stitching, or any other operable method effective to attach the membranes 232, 235 together. Space 241 in a pocket 229 desirably is at least substantially filled by fire suppression compound 244 prior to forming the seal between membranes 232 and 235.

The thickness, length "L" and/or width "W" of a pouch or pocket may be determined in accordance to certain factors including the amount of fire-extinguishing agent desired to be held therein, and a radius of curvature desired to be formable in a blanket. It has been determined that a pouch forming about a six-inch square having about a one-inch thickness can hold about one pound of an operable fire extinguishing agent. Such amount of commercially available fire-extinguishing agent has been determined to be effective in mitigating the deflagration of a 5-gallon container of gasoline that is shot by a .50 caliber incendiary round.

With reference to FIG. 9, length "L" and width "W" of a pocket are not required to be aligned with the length and width of a blanket. Furthermore, alternative pocket shapes, including diamond and non-rectangular, are within contemplation. Seams between pockets may be nonaligned in a vertical and/or horizontal direction. For example, contrary to the illustration of FIG. 9, vertical alignment of seams of row 245 may be staggered in relation to corresponding vertical seams of row 246.

Figure 11:
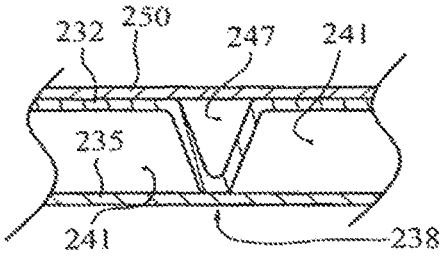
FIG. 11 is a cross-section view, similar to FIG. 10, taken through a blanket having an alternative construction.

With reference to FIGS. 10 and 11, spaces 247, between individual pockets 229, may optionally be filled with additional fire suppression compound to resist shot lines, or voids, at pocket seams. Subsequent to filling, space 247 may then be covered, e.g. with a flexible, hermetically sealing membrane 250, such as polyurethane (or alternatively, a resin having adequate flexible and sealing properties upon its cure, or even a pre-formed sheet material), as a final sealing layer. The sealing membrane 250 may be applied as a sheet material, or can sometimes be sprayed onto a blanket, or may be applied using some other known method. In a workable embodiment, a blanket 226 (e.g. FIG. 9) may be produced in a continuous sheet using reel-to-reel manufacturing techniques (make, fill, seal), and may be cut to a desired length, and/or width, prior to installation to protect a container.

Figure 12:
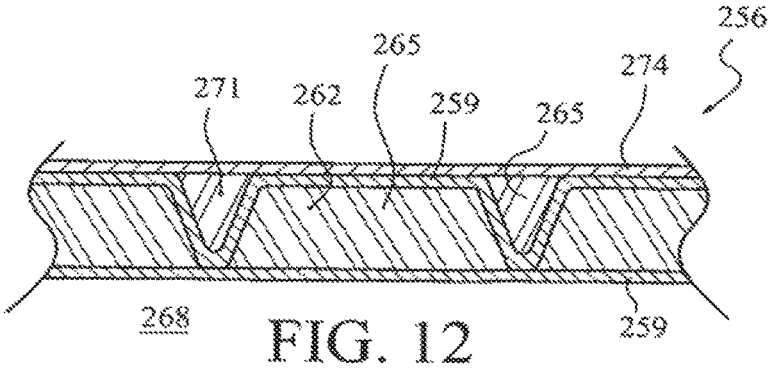
FIG. 12 is a cross-section view, similar to FIG. 11, taken through a blanket having an alternative construction.

With reference now to FIG. 12, the blanket indicated generally at 256 includes a ballistic protection layer, formed from materials such as Spectra (Allied) or Kevlar (DuPont) as the inner-layer 259, which is formed into pockets 262 adapted to hold the fire-fighting agent 265. The ballistic layer can also be installed directly to the protected container 268 of flammable/combustible material. This ballistic protection variation may be formed with a material similar to Spectra or Kevlar when small arms ballistic protection is required. The volume or space 271 between the pockets 262 in certain embodiments may be filled with fire-fighting agent 265 and then covered with a polyurethane layer 274, or similar resin, as a final sealing layer. The polyurethane may be applied as a sheet material or sprayed onto the product or by some other workable method. If liquid or gaseous fire-fighting agents are selected for inclusion in a pocket, pouch, or space, additional sealing layers may be added as required.

Figure 13:
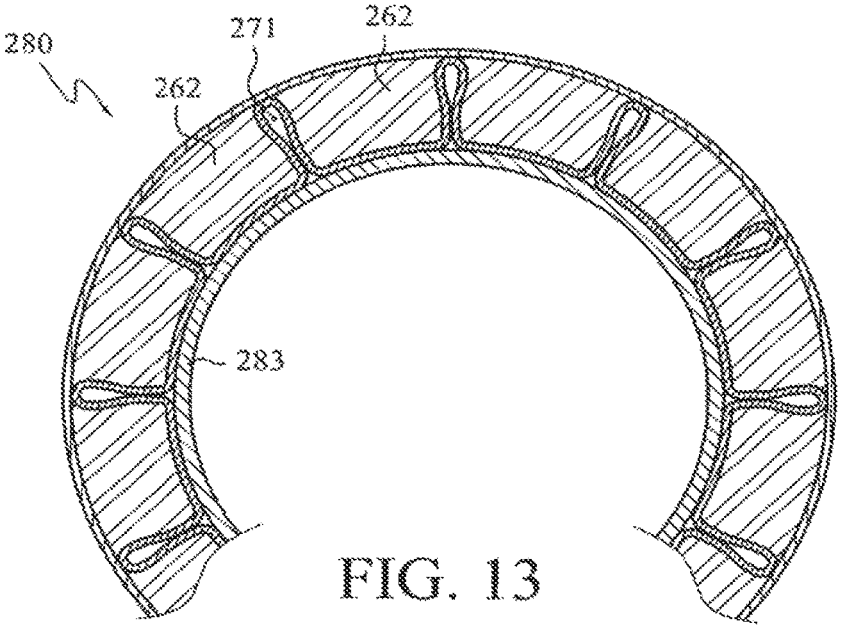
FIG. 13 is a cross-section view of the blanket structure option illustrated in FIG. 12, in an installed position on a curved container.

FIG. 13 illustrates a blanket, generally indicated at 280, structured in correspondence with FIG. 12, but not including filler material inside spaces 271. Blanket 280 is illustrated as being wrapped around the exterior shell 283 of a container of flammable/combustible liquid. During installation of blanket 280, spaces 271 may be compressed to permit changing blanket 280 from a substantially planar shape to a curved shape. Spaces 271 are inevitably reduced during such curving operation, thereby reducing size of shot lines, or voids between pockets 262.

When present, the ballistic layer 259 may be applied in at least three different ways: attached with or as the lower sealing sheet; formed in a pre-preg as the pouch layer and then sealed in conventional fashion; or as a cape material to be either thermoformed into the pouch shape or sewn so as to create pockets into which the fire extinguishing material 265 can be contained. The containment inside the pockets 262 can be effected either by directly adding the powder material (perhaps as a packed powder or as loose powder) or the powder can be contained within a pouch which is then placed into the pocket 262 or onto the antiballistic layer(s) and then sewn into place in pockets. Such ballistic protection variation may be formed using a material similar to Spectra or Kevlar when small arms protection is desired.

Certain embodiments may be manufactured by including a pill or cake of dry chemical fire-extinguishing agent inside each of a plurality of adjacent pockets or pouches. Such embodiments can then be subjected to an exterior energy source, such as microwave or ultrasonic processes, effective to shatter the dry chemical pill, thereby giving fluidity of the dry chemical inside the pocket subsequent to product sealing. The exterior energy source may sometimes be employed to re-fluidize the fire-extinguishing agent inside a pocket after a period of time during storage or service.

Sometimes, fire extinguishing agent may simply be poured into pockets or pouches, which are then sealed. In an alternative assembly, the agent may be bagged inside a pouch and the pouch may be fitted into a pocket. In the latter case, an additional sealing layer may sometimes be applied to retain a pouch in registration with a pocket, and/or to increase robustness and resistance to moisture and contaminants.

Figure 14:
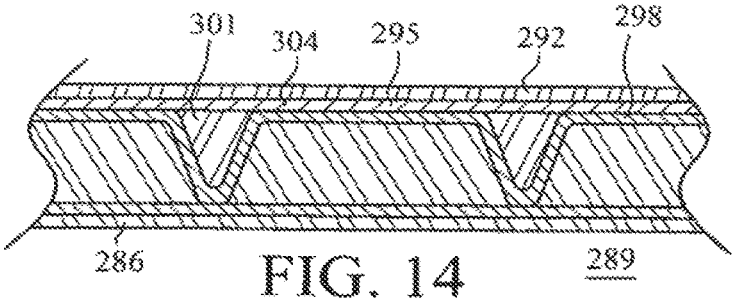
FIG. 14 is a cross-section view through a blanket having an alternative construction.

With reference now to FIG. 14, a layer of self-sealing material 286 may also be applied next to the flammable or combustible material container 289 operably to seal the container should the ballistic material 292 fail to absorb the energy from an impacting projectile. The outer layer 295 and fire-fighting pocket 298 could be structured similar to the first disclosed embodiment. In certain cases, the gap receives pill 301 and then may be covered with a polyurethane 304, or similar resin, or even an additional full-width sheet, as a final sealing layer. For example, a sealing material, such as polyurethane, may be applied as a preformed sheet, or sprayed onto the product in localized areas, or may be applied by some other operable method.

It may be useful to insert the dry fire-extinguishing agent in a cake, or pill form. Certain operable dry chemical fire-fighting agents can be mixed with a predetermined amount of water and desiccant agent specifically selected based upon the application where size and capacity of the pouch or pocket is arranged to meet the performance threats. The liquid/dry chemical mixture is then compressed with sufficient pressure to retain the compressed shape which forms the two exemplary pill shapes 307, 310 shown in FIG. 14. Following formation, the pills 307, 310 may be weighed prior to insertion in the process discussed above. Of course, in contrast to the illustrations, an alternative and workable pill may have a cross-section shape that does not agree perfectly with a cross-section shape of its associated pouch. It is desirable for the pill (or collection of pills) to provide sufficient volume of fire extinguishing agent to substantially fill the volume of a pocket, to resist formation of an empty pocket portion that could form a blank space in the container protection (called a "shot line"), through which a projectile could pass without necessarily broadcasting fire extinguishing agent.

Figure 15:
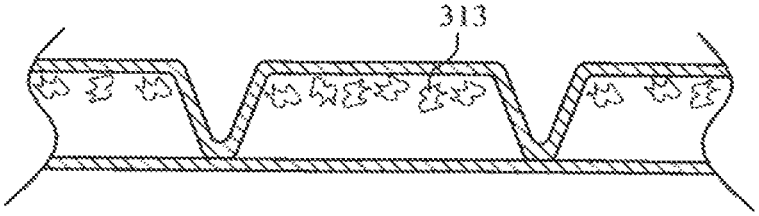
FIG. 15 is a cross-section view through a blanket having an alternative construction.

Also, in certain embodiments a limited amount of dry ice (carbon dioxide) 313 may be inserted into each pocket, prior to insertion of the dry chemical fire-fighting agent pill (see FIG. 15). The carbon dioxide 313, when present, can act as additional propulsion for the dry chemical fire-fighting agent when the pouch is impacted and the agent is released into the fire/fuel interface in a direct application approach.

Figure 16:
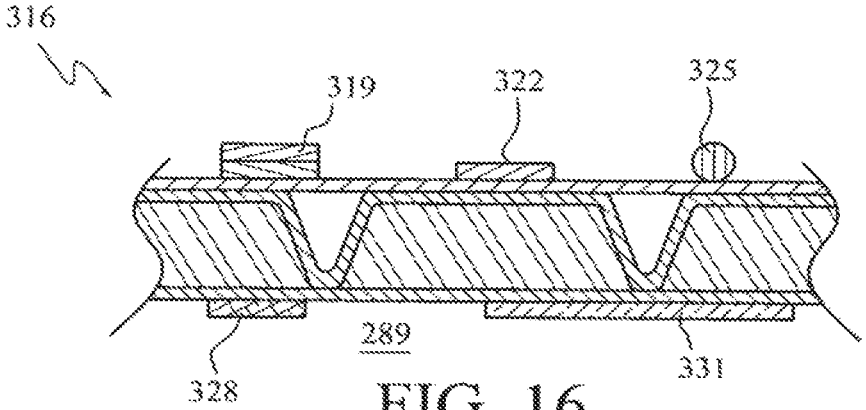
FIG. 16 is a cross-section view through a blanket having an alternative construction.

With reference now to FIG. 16, a fire-protection blanket, generally indicated at 316, may be secured in place to a flammable/combustible material container 289 by means of stainless steel bands 70, plastic tie-wraps 71, cord 72, which may encompass polyethylene or stainless steel cord, double sticky back tape 73, adhesive materials 74 or other workable structure to allow for ease of installation and removal of the blanket e.g. for maintenance of the flammable/combustible material container or blanket. The blanket sections are typically applied in such a manner so as to completely cover the outer surfaces of the tank or flammable/combustible material container 289. If the surface configuration of the tank or container has small radius complex bends then formed pouches (including rigidly formed pouches) may sometimes be applied to these specific areas as a means of applying complete protection coverage, thus avoiding creation of voids wherein the fire-fighting agent is not applied uniformly.

Fire suppression blankets may alternatively be attached to a container of flammable/combustible liquid by using tie-wraps, rope, small gauge non-corrosive wire, film adhesives, spray adhesives, or liquid adhesive products, and the like, that are commercially available. Other attachment structures that insure ease of installation (and sometimes removal), may also be utilized as they become available, or in response to a particular requirement. One operable attachment includes a plurality of tie wraps disposed to trap the blanket against the exterior of the container. Operable tie wraps include Pan-Steel (Panduit) banding part number MSW38T15-CR6. Sometimes a protective layer may also be included, such as protective cushion part number PCSS-B-CR that is installed to protect the band from rubbing against the outer surface of the blanket. The Pan-Steel banding may be tightened and cut with the installation tool BT1HT. Should the installation require non-metallic attachment, an operable attachment structure includes Dual-Lock (3M) Model 2550 cut to perhaps ½" (12 mm) widths, or so, and appropriate length based upon size of container and weight of the blanket.

Figure 17:
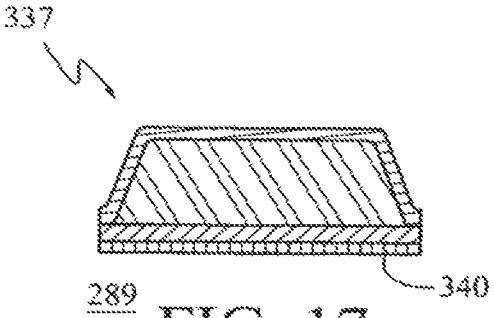
FIG. 17 is a cross-section view of a replacement pocket.

With reference now to FIG. 17, another aspect included in certain embodiments of the invention includes one or more repair pocket 337 that can be field-applied to repair a single pocket or multiple pockets which may be damaged by impacts with sharp objects or other non-fire threatening occurrences during routine operations around a vehicle or flammable/combustible material container. In such embodiments, the pockets of a blanket are desirably formed to facilitate the removal of a damaged pocket and to permit application of a new pocket 337 to effect a repair. The repair pockets can be attached using a film adhesive 340, or similar appropriate adhesive support product, which may be applied to the container or portion of a blanket to effect a substantially complete coverage of a desired portion of the flammable/combustible material container 289. Operable adhesives include polyethylene or other tough adhesive material or any suitable material for attachment to the flammable/combustible liquid container based upon the operating conditions. Certain repair pockets may be attached using thermobonding techniques. Similarly, certain blankets may be structured to permit replacement of one or more damaged pouch, such as a pouch 214.

Figure 18:
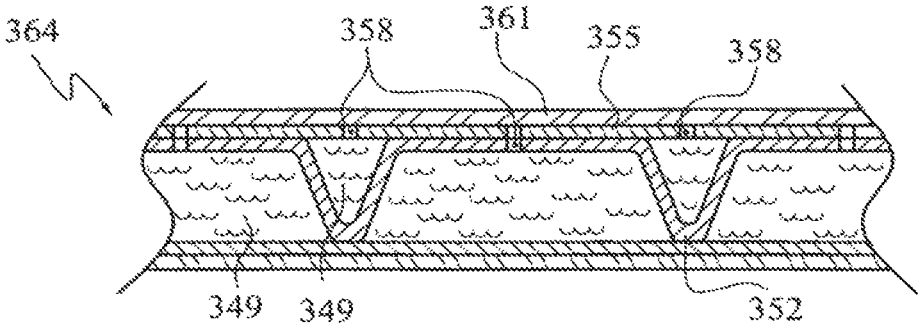
FIG. 18 is a cross-section view through a blanket having an alternative construction.

Referring now to FIG. 18, another alternative embodiment, generally indicated at 346, includes liquid fire-fighting agents 349 inserted in the pouch layer 352 in lieu of (or sometimes in addition to) a dry chemical agent. An additional membrane layer 355 will generally be added to seal the liquid/gaseous agent fill opening, which typically includes small holes 358 appropriate to the fire-fighting agent. Fire-fighting agent 349 may be installed in gaps between pouches subsequent to sealing the outer layer 361 to layer 355.

Figure 19:
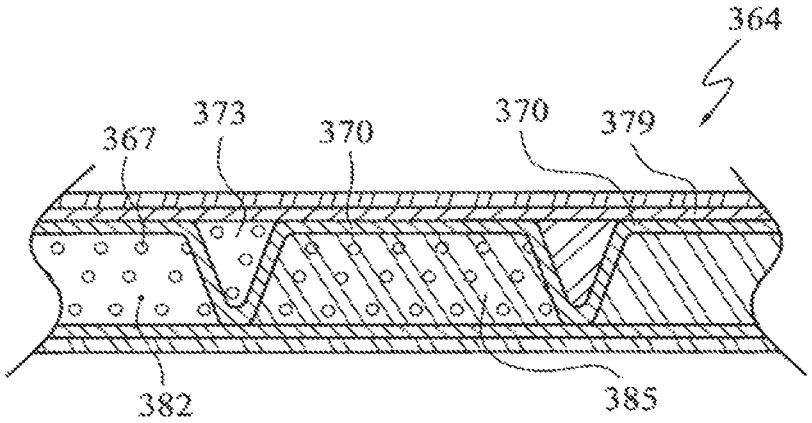
FIG. 19 is a cross-section view through a blanket having an alternative construction.

With reference now to FIG. 19, another variation structured according to certain principles of the instant invention, and generally indicated at 364, includes the use of gaseous fire-fighting agents 367 inserted in the pouch layer 370 in lieu of the dry chemical pills 352. Such agents can be inserted as either a liquid or gas after the pouches are formed and the second layer 376 is applied. Additional layers 379 will typically be added to seal the agent-fill holes. Gaseous agents 367 may be lowered to the appropriate temperature to create a liquid poured into appropriate mold shapes to fit within the pouches and then lowered in temperature to a solid state. The gaseous agents 367 are generally stored at an appropriate temperature until they are inserted into the pocket 382. Within a blanket, the gaseous agents may be a solid, a liquid or a gas depending upon the operating environment in which the container to be protected is stored or used. Gaseous agent pills must typically be monitored to insure that a loss of agent quantity does not occur during the insertion process.

As a variety of special fire protection needs exist within the realm of flammable/combustible material manufacturing, another embodiment (still with reference to FIG. 19) includes the insertion of mixed fire-fighting agents 385 such as: dry chemical/gaseous agents, liquid/gaseous agents and dry chemical/liquid agents. These selective alternate assemblies naturally require appropriate processes to insure the purity of the fire-fighting agents and sufficient layers 379 to adequately seal the pockets against leakage. Such alternative embodiments are not limited to any specific combination or fire-fighting chemicals.

Figure 20:
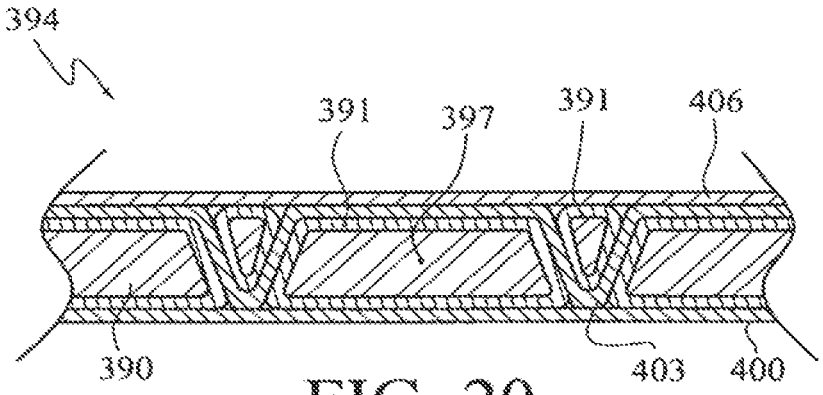
FIG. 20 is a cross-section view through a blanket having an alternative construction.

With reference now to FIG. 20, it is within contemplation for fire-extinguishing agent 390 to be bagged into separate individual pouches 391 to form certain blankets 394 within the ambit of the instant invention. The pouches 391 may then be disposed into a respective preformed pocket 397, created between inner layer 400 and pocket layer 403, as well as (optionally) certain spaces formed between pocket layer 403 and outer sealing layer 406.

Figure 21:
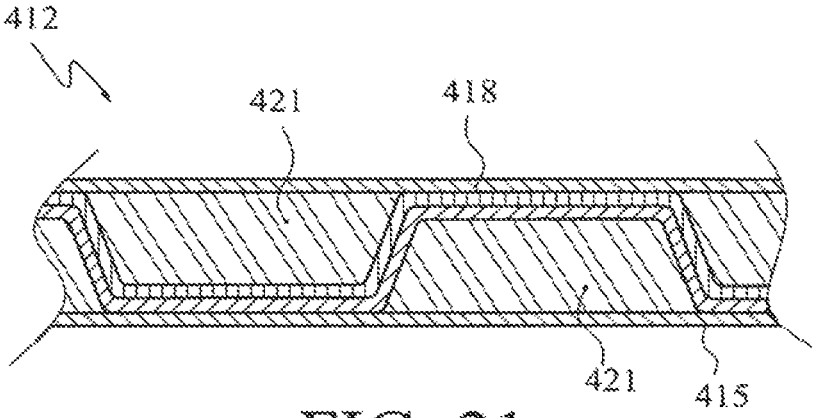
FIG. 21 is a cross-section view through a blanket having an alternative construction.

FIG. 21 illustrates a blanket 412 having an alternative construction including first and second sheets, 415, 418, respectively, that are affixed in an interlocking arrangement to form a blanket 412, typically having a symmetrical pattern of pockets 421. The pockets 421 in both first sheet 415 and second sheet 418 are formed in an offset pattern, with a spacing between each pocket 421 being sized in accordance with a pocket width or length. The first and second blankets may be formed, filled, and sealed in accordance with a previously described procedure, or other workable procedure. Then, the first blanket sheet is turned upside-down, and its filled pockets are fitted into reception in sockets formed by spaces between pockets in the second right-side-up blanket sheet. As illustrated, the resulting cross-section somewhat resembles cardboard. The two blanket sheets may be affixed to each other by thermoforming, welding, or adhesive techniques, and the like.

Figure 22:
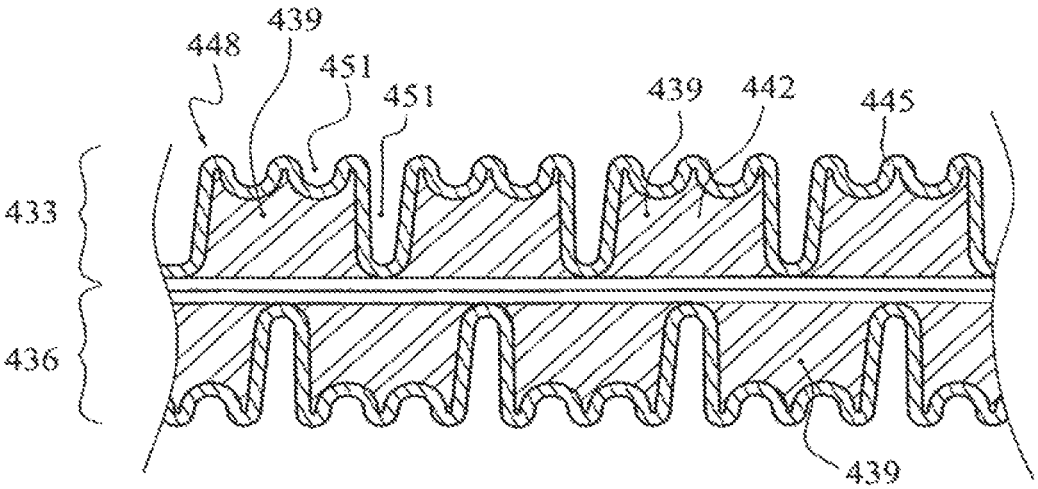
FIG. 22 is a cross-section view through a blanket having an alternative construction.

FIG. 22 illustrates an alternative embodiment, generally indicated at 430, adapted for wrapping around a curved portion of a container while avoiding creation of shot lines. As illustrated, the blanket 430 may be formed by placing a pair of layers 433, 436 back-to-back. The illustrated layers 433, 436 include pouches or pockets 439 in which to hold fire extinguishant material. Wall portions 445 of such pockets 439 include a plurality of hills 448 and valleys 451 that are configured to stretch, or compress, as required, to conform to the curvature of a container around which the blanket 430 is draped. As illustrated, valleys 451 can be included between individual pockets 439 to further enhance drapability of the blanket over a curved surface. When the illustrated blanket 430 is wrapped around a cylindrical container, the outer sheet, e.g. 433, will tend to "smooth out" and the inner sheet, e.g. 436, will tend to "bunch up". As also illustrated, it is preferred to provide offset pockets 439, with a valley 451 on the outer sheet 433 disposed offset from a valley 451 of the inner sheet 436. Such configuration resists formation of shot lines through a wrapped blanket 430.

While the invention has been described in particular with reference to certain illustrated embodiments, such is not intended to limit the scope of the invention. The present invention may be embodied in other specific forms without departing from its spirit or essential characteristics. The described embodiments are to be considered as illustrative and not restrictive. For example, one or more element present in one or more exemplary embodiment may be incorporated, or substituted, into an alternative embodiment to thereby create a still further alternative embodiment within the ambit of the instant invention. The scope of the invention is, therefore, indicated by the appended claims rather than by the foregoing description. All changes which come within the meaning and range of equivalency of the claims are to be embraced within their scope.

The invention claimed is:

1. A fuel tank cover comprising:

a shell comprising a first plurality of pockets formed as a first layer of pockets that further comprises:

a blanket with a first portion of the first plurality of pockets disposed in a first direction, a first end cap coupled perpendicular to a first edge of the blanket, the first end cap comprising a second portion of the first plurality of pockets disposed perpendicular to the first portion of the first plurality of pockets, a second end cap coupled perpendicular to a second edge of the blanket opposite the first edge of the blanket, the second end cap comprising a third portion of the first plurality of pockets disposed perpendicular to the first portion of the first plurality of pockets;

a replaceable elongate two-layer pouch disposed in each of the plurality of pockets, wherein the two-layer pouch comprises an inner layer and an outer layer surrounding the inner layer; and a fire suppression material disposed within each of the two-layer pouches.

2. The fuel tank cover of claim 1, further comprising:

the first end cap being arranged as a first short cylindrical section; and the second end cap being arranged as a second short cylindrical section.

3. The fuel tank cover of claim 1, further comprising a second layer of pockets structured with the first layer of pockets to cover an area between adjacent pockets in the first layer forming a staggered pocket arrangement through a thickness of the fuel tank cover.

4. The fuel tank cover of claim 1, further comprising a flap like cover (access to gas cap) coupled to the shell with a fastener arraignment.

5. The fuel tank cover of claim 4, wherein the replaceable elongate two-layer pouches are elongate and comprise a length greater than a width, the width being greater than a thickness.

6. The fuel tank cover of claim 5, wherein each pocket of the first plurality of pockets comprises a re-closeable access opening.

7. The fuel tank cover of claim 6, wherein the re-closeable access opening is formed by a zipper.

8. A fuel tank cover comprising:

a shell comprising a first plurality of pockets formed as a first layer of pockets, the shell further comprising:

a blanket with a first portion of the first plurality of pockets disposed in a first direction;

a first end cap coupled perpendicular to a first edge of the blanket, the first end cap comprising a second portion of the first plurality of pockets disposed perpendicular to the first portion of the first plurality of pockets; and a second end cap coupled perpendicular to a second edge of the blanket opposite the first edge of the blanket, the second end cap comprising a third portion of the first plurality of pockets disposed perpendicular to the first portion of the first plurality of pockets;

a two-layer replaceable pouch disposed in each of the plurality of pockets comprising an inner layer and an outer layer surrounding the inner layer;

a fire suppression material disposed within each of the replaceable pouches; and wherein the shell is for application to the fuel tank in anticipation of a ballistic impact.

9. The fuel tank cover of claim 8, wherein the first plurality of pockets comprise re-closeable access openings.

10. The fuel tank cover of claim 8, further comprising a second plurality of pockets formed as a second layer of pockets to cover an area between adjacent pockets in the first layer forming a staggered pocket arrangement through a thickness of the fuel tank cover.

11. The fuel tank cover of claim 8, further comprising forming a self-sealing material over the shell to seal the container from ballistic material.

* * * * *